US010619955B2

(12) United States Patent
Wyssen

(10) Patent No.: US 10,619,955 B2
(45) Date of Patent: Apr. 14, 2020

(54) SPRING SYSTEM FOR BLOWBACK ACTION FOR PISTOL-CALIBER FIREARMS

(71) Applicant: Wyssen Defence AG, Reichenbach (CH)

(72) Inventor: Juerg Wyssen, Reichenbach (CH)

(73) Assignee: Wyssen Defence AG, Reichenbach (CH)

( * ) Notice: Subject to any disclaimer, the term of this patent is extended or adjusted under 35 U.S.C. 154(b) by 0 days.

(21) Appl. No.: 16/277,388

(22) Filed: Feb. 15, 2019

(65) Prior Publication Data

US 2019/0383571 A1 Dec. 19, 2019

(30) Foreign Application Priority Data

Jun. 19, 2018 (CH) ..... 0780/18

(51) Int. Cl.
*F41A 3/82* (2006.01)

(52) U.S. Cl.
CPC ..... *F41A 3/82* (2013.01)

(58) Field of Classification Search
CPC ..... F41A 3/82; F41A 3/80; F41A 3/84; F41A 3/86; F41A 3/88; F41A 3/94; F41A 3/92; F41A 3/78
USPC ..... 89/199
See application file for complete search history.

(56) References Cited

U.S. PATENT DOCUMENTS

| | | | | | |
|---|---|---|---|---|---|
| 1,356,191 | A * | 10/1920 | Craig | F41A 3/78 | 89/198 |
| 3,861,274 | A * | 1/1975 | Perrine | F41A 3/38 | 89/180 |
| 4,383,471 | A * | 5/1983 | La Fever | F41A 7/02 | 89/1.4 |
| 4,977,815 | A * | 12/1990 | Stephens | F41A 3/62 | 42/16 |
| 8,800,424 | B2 | 8/2014 | Gangl et al. | | |
| 2004/0007124 | A1* | 1/2004 | Nakatani | F41A 3/64 | 89/196 |
| 2010/0186581 | A1* | 7/2010 | Hajjar | F41A 3/46 | 89/188 |
| 2011/0167704 | A1* | 7/2011 | Chupp | F41C 27/00 | 42/90 |
| 2012/0210623 | A1* | 8/2012 | Alis | F41A 3/66 | 42/14 |
| 2014/0216243 | A1* | 8/2014 | Coffman, II | F41A 3/82 | 89/196 |

* cited by examiner

*Primary Examiner* — John Cooper
(74) *Attorney, Agent, or Firm* — Volpe and Koenig, P.C.

(57) ABSTRACT

A spring system for blowback action is provided with a control piece (2) and pusher piece (3) supported so that it can be displaced on the guide rod (7). On its end, a buffer (4) is arranged with a buffer spring (6). The guide rod (7) is also used for guiding the closing spring (8). Between the control piece (2) and pusher piece (3) there are five rollers (10) in a recess (9) of the guide rod (7), and these rollers cause a delay of the action during the blowback after the discharge of a shot.

7 Claims, 5 Drawing Sheets

SPRING SYSTEM FOR BLOWBACK ACTION FOR PISTOL-CALIBER FIREARMS

INCORPORATION BY REFERENCE

The following documents are incorporated herein by reference as if fully set forth: Swiss Patent Application No. 00780/18, filed Jun. 19, 2018.

BACKGROUND

The present invention relates to a spring system for delaying the action for pistol-caliber firearms with blowback action.

Blowback loaders use the energy from the recoil to open the chamber after a shot, eject the cartridge shell, and feed a new cartridge from the magazine into the chamber. Different action types with their advantages and disadvantages have been developed over the course of time. In principle, a distinction is made between two types—unlocked blowback action and locked recoil action. In both types, the chamber is opened only when the projectile has left the barrel and the gas pressure has decreased to a non-critical value.

For the blowback action, also called spring-mass bolt action, the barrel and bolt are not connected to each other mechanically; the bolt acts only through its mass inertia and through the pressure of the closing spring. The bolt sits directly behind the cartridge chamber and presses on the base of the cartridge. The bolt is held, in turn, by the closing spring that is supported on the weapon's housing.

After the propellant charge is ignited, a high gas pressure occurs in the interior of the cartridge shell; this pressure sets the projectile in motion toward the front of the weapon and the bolt in motion toward the back. The speed of the bolt must remain low enough that the cartridge shell slides backward in the chamber only a short distance while the pressure in its interior is so high that it could cause damage or injury. This is achieved in that the mass of the bolt is significantly greater than that of the mass of the projectile. Ideally, an identical motion impulse is transferred to the projectile and to the bolt during a shot. According to the law of conservation of momentum, in the much heavier bolt, this impulse leads to a significantly lower velocity.

After the projectile has left the barrel, the bolt continues to move backward due to its mass inertia, wherein the cartridge shell is pushed out completely from the cartridge chamber and ejected. The stored spring energy increases as the compression of the spring increases. When the bolt has discharged all its kinetic energy to the spring or impacts against a stop and in this way comes to be in its rear dead point, it is accelerated forward again by the spring, wherein a new cartridge is guided out of the magazine into the cartridge chamber.

In weapons with delayed blowback action, the barrel sits rigidly in the housing and is locked semi-rigidly with the bolt. The bolt has two parts; at the front, the bolt head is connected movably to the control piece. The pressure produced during a shot on the end side of the bolt head causes minimal backward movement. This movement is transferred by a suitable mechanism to the control piece and greatly accelerates this piece. During blowback, the control piece releases the locking of the bolt head and moves with the bolt head backward, which triggers the reloading process.

SUMMARY

A spring system for blowback action for pistol-caliber firearms is provided having a guide rod and at least one closing spring. For enhanced performance, the spring system includes a control piece connected to a pusher piece, between which there are at least two roller bodies.

With the present spring system, the closing parts and housing are moved by the gas pressure without time delay. By the simultaneous play-free beginning of all movements of the closing parts and the housing, shock-like and uncontrolled impacts are avoided. The force resulting from the kickback acts in a time profile without force spikes, which promotes material savings and is beneficial to precision.

Further advantages and features of the invention are explained below and in the claims.

BRIEF DESCRIPTION OF THE DRAWINGS

Below, an embodiment of the spring system according to the invention for retrofitting a spring-mass bolt action into a delayed blowback action will now be explained in more detail with reference to the drawing. Shown therein are.

DETAILED DESCRIPTION

Figure 1:
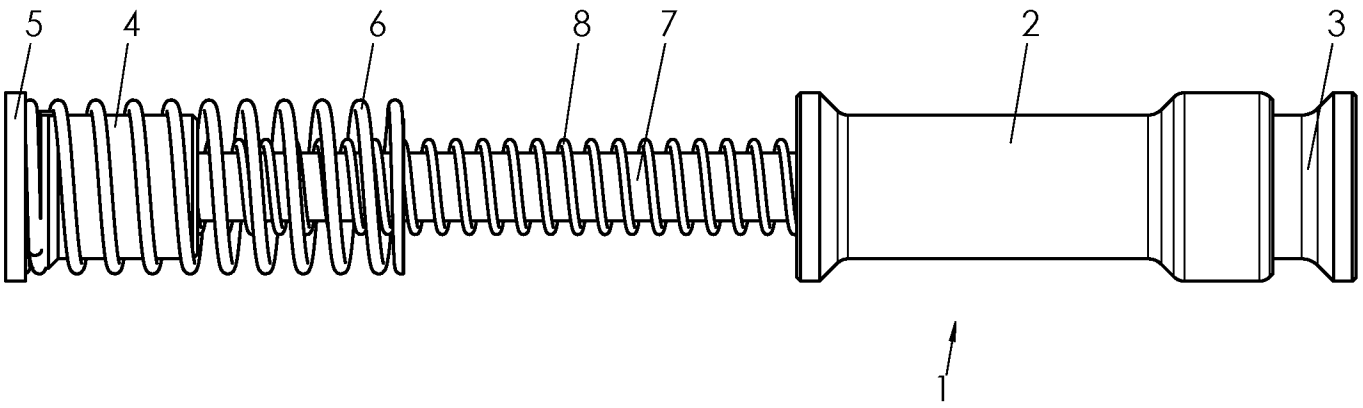
FIG. 1 a view of the spring system.

From FIG. 1 it is clear that the spring system 1 and the not-shown bolt that interacts with this spring system are supported in the not-shown housing. The spring system 1 includes a control piece 2 and a pusher piece 3 connected to it. A buffer 4 is supported with the support part 5 on the not-shown housing of the weapon. The buffer 4 is provided on the outside with the buffer spring 6 and in its interior, the spring guiding rod 7 is supported with the closing spring 8. The not-shown bolt contacts the pusher piece 3.

Figure 2:
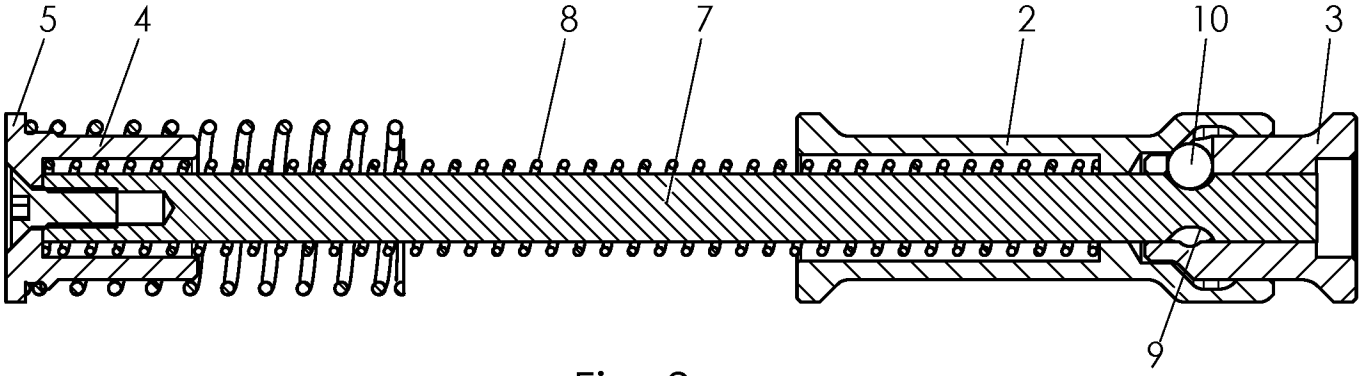
FIG. 2 the spring system in sectional representation in closed rest position, FIG. 3 the spring system in the stop at the very back, FIG. 4 a partial section of the spring system in the rest position of the bolt, FIG. 5 the partial section of FIG. 4 shortly after the discharge of a shot, FIG. 6 schematically, a force-displacement diagram, and FIG. 7 a spring system variant.

According to FIG. 2, the buffer 4 is supported with its support part 5 on the housing of the weapon, while the closing spring 8 presses the control piece 2 and the pusher piece 3 connected to it, as well as the not-shown bolt, against the not-shown cartridge base. The spring guide rod 7 has, over its periphery, a recess 9 in which 5 equally-spaced rollers 10 are supported.

Figure 3:
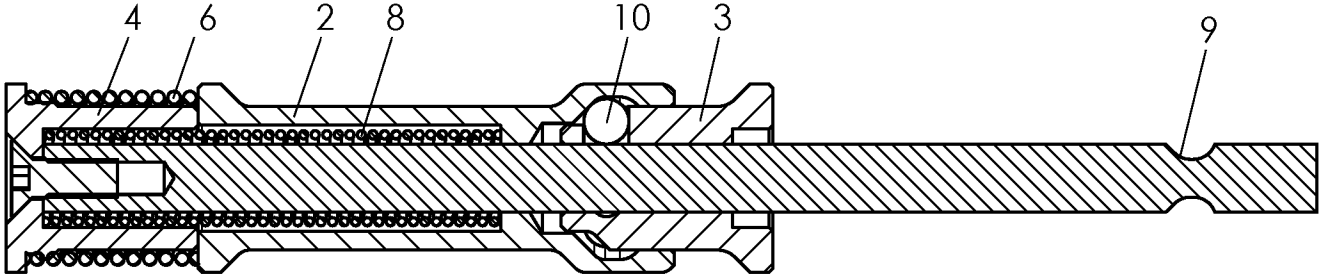

FIG. 3 shows how the pusher piece 3 is pressed by the not-shown bolt against the rear stop after a shot. Here, the rollers 10 are moved out of the recess 9 and the control piece 2 impacts on the buffer 4, wherein the buffer spring 6 and the closing spring 8 are compressed. Then the bolt is pushed by the springs 6 and 8 back into the rest position shown in FIG. 2.

Figure 4:
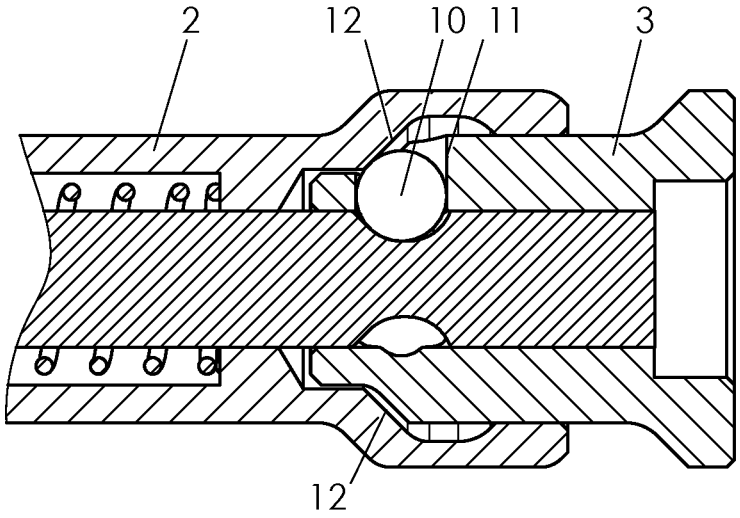

According to FIG. 4, in the rest position, the balls 10 are supported in holes 11 of the pusher piece 3 and pressed against the inner surface 12 of the control piece 2 arranged below 45°.

Figure 5:
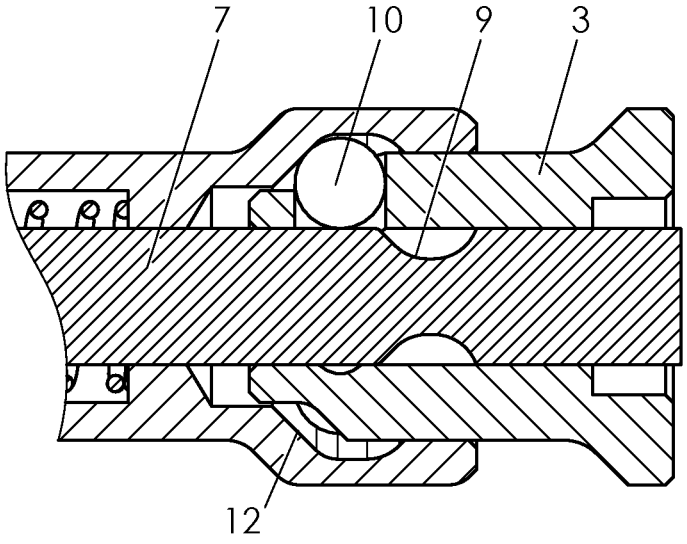

As shown in FIG. 5, after the discharge of the shot, the pusher piece 3 presses the rollers 10 out of the recess 9 onto the spring guide rod 7 and farther outward onto the inner surface 12. In this process, the return of the pusher piece 3 and the not-shown bolt is delayed, wherein the return force is dissipated. This is shown schematically in the force-displacement diagram of FIG. 6.

Figure 6:
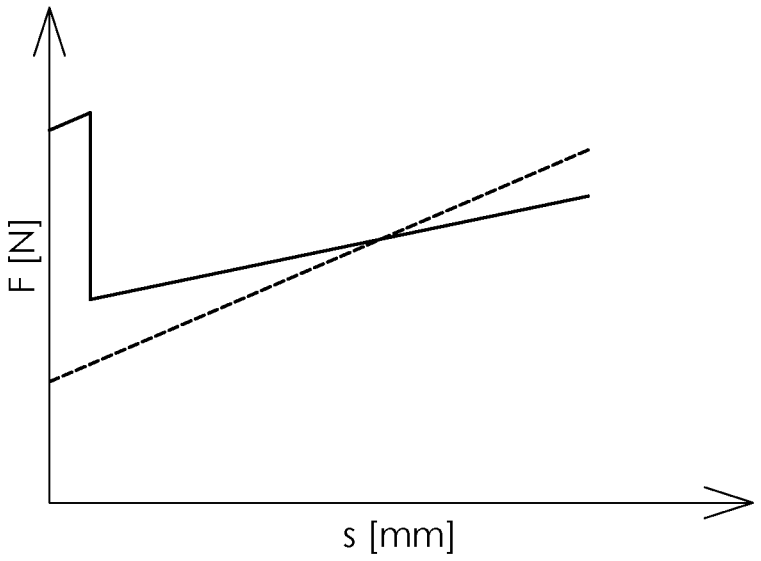

FIG. 6 shows a schematic force-displacement diagram of the return force acting on the bolt as a function of the return distance once for the spring system according to the invention and once, with a broken line, the profile of a pure spring-mass bolt.

Figure 7:
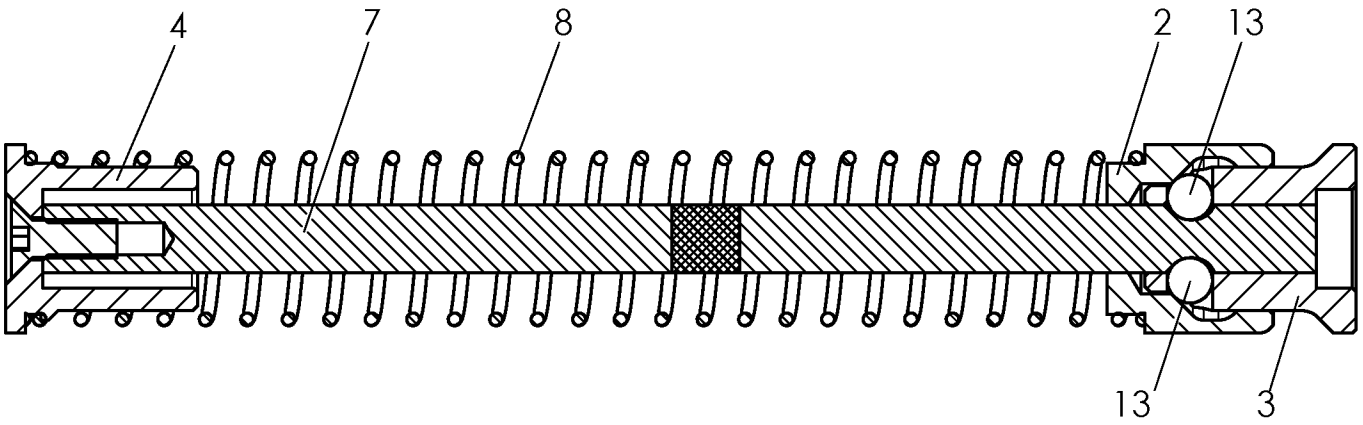

In the variant according to FIG. 7, only the closing spring 8 arranged on the outside on the buffer 4 and the control piece 2 is still present. Between the control piece 2 and the pusher piece 3 there are two rollers 13, wherein the spring guide rod 7 has a square cross section and the rollers 13 contact the control piece 2, the pusher piece 3, and the spring guide rod 7 in a linear fashion.

In the blowback action with the spring system according to the invention, the closing parts and housing are moved by the gas pressure without time delay. By the simultaneous play-free beginning of all movements of the closing parts and the housing, shock-like and uncontrolled impacts are avoided. The force resulting from the kickback acts in the time profile without force spikes, which promotes material savings and is beneficial to precision. Conventional weapons with spring-mass bolts can be retrofitted with the spring system according to the invention and therefore become a weapon with delayed blowback action.

The invention claimed is:

1. A spring system for blowback action for firearms, the spring system comprising:

a guide rod, a spring system having at least one closing spring, a control piece, a pusher piece, with the control piece being connected to the pusher piece, and at least two roller bodies located between the control piece and the pusher piece, and the control piece and the pusher piece are slidably arranged on the guide rod, and the at least two roller bodies comprise five rollers that are arranged in a recess of the guide rod.

2. The spring system for blowback action according to claim 1, wherein, in a rest position, the rollers supported in the recess and in holes of the pusher piece, and are pressed against an inner face of the control piece, said inner face is inclined at an angle of less than 45°.

3. The spring system for blowback action according to claim 1, further comprising a buffer spring that is adapted to contact the control piece in a blow back position.

4. The spring system for blowback action according to claim 1, further comprising a buffer located at an end of the guide rod.

5. A spring system for blowback action for firearms, the spring system comprising:

a guide rod, a spring system having at least one closing spring, a control piece, a pusher piece, with the control piece being connected to the pusher piece, and at least two roller bodies located between the control piece and the pusher piece, and the control piece and the pusher piece are slidably arranged on the guide rod which has a square cross section, and the two rollers are arranged between the pusher piece and control piece.

6. The spring system for blowback action according to claim 5, further comprising a buffer spring that is adapted to contact the control piece in a blow back position.

7. The spring system for blowback action according to claim 5, further comprising a buffer located at an end of the guide rod.

* * * * *